United States Patent [19]

Richards

[11] 4,383,910

[45] May 17, 1983

[54] ALUMINA REDUCTION CELL

[75] Inventor: Nolan E. Richards, Florence, Ala.

[73] Assignee: Reynolds Metals Company, Richmond, Va.

[21] Appl. No.: 265,900

[22] Filed: May 21, 1981

[51] Int. Cl.[3] ..... C25C 3/08; C25B 11/12

[52] U.S. Cl. ..... 204/243 R; 204/294

[58] Field of Search ..... 204/67, 243 R–247, 204/294, 291, 286

[56] References Cited

U.S. PATENT DOCUMENTS

| | | | |
|---|---|---|---|
| 4,219,391 | 8/1980 | Foster, Jr. | 204/243 R X |
| 4,224,128 | 9/1980 | Walton | 204/243 R |
| 4,231,853 | 11/1980 | Rahn | 204/243 R |
| 4,243,502 | 1/1981 | Kugler | 204/243 R |
| 4,308,114 | 12/1981 | Das et al. | 204/294 X |
| 4,308,115 | 12/1981 | Foster, Jr. et al. | 204/294 X |

FOREIGN PATENT DOCUMENTS

| | | | |
|---|---|---|---|
| 318633 | 12/1971 | U.S.S.R. | 204/286 |

*Primary Examiner*—Donald R. Valentine

*Attorney, Agent, or Firm*—Alan T. McDonald

[57] ABSTRACT

An improved alumina reduction cell is described in which the carbonaceous cathode includes refractory hard metal tiles projecting upwardly from the cell surface thereof, forming the true cathode surface, and a solid layer of alumina and cryolite beneath the molten aluminum produced within the cell and the alumina-cryolite bath from which the molten aluminum is obtained. This bottom alumina-cryolite layer protects the refractory hard metal-carbonaceous interface from attack by the molten aluminum, increasing the useful life of the cell.

5 Claims, 1 Drawing Figure

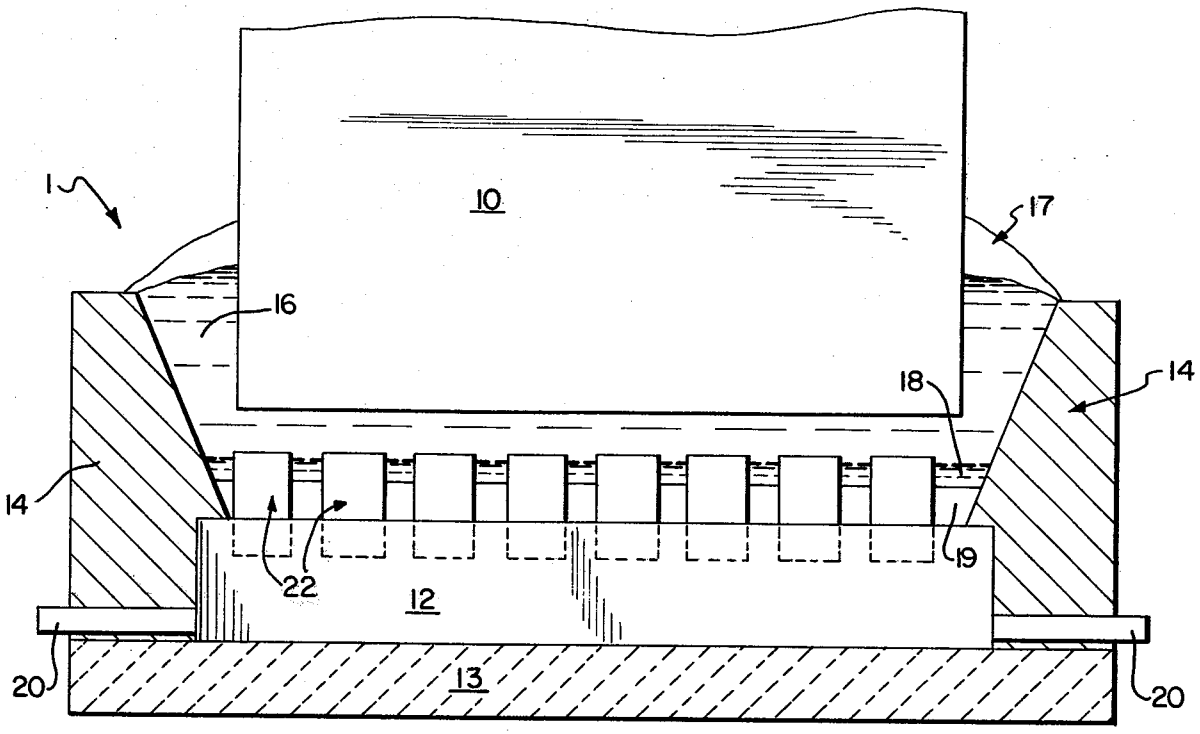
14
20
17
19
18
10
12
13
22
16
1
14
20

ALUMINA REDUCTION CELL

BACKGROUND OF THE INVENTION

Aluminum metal is conventionally produced by the electrolytic reduction of alumina dissolved in a molten cryolite bath according to Hall-Heroult process.

This process for reducing alumina is carried out in a thermally insulated cell or "pot" which contains the alumina-cryolite bath. The cell floor, typically made of a carbonaceous material, overlies some of the thermal insulation for the cell and serves as a part of the cathode. The cell floor may be made up of a number of carbonaceous blocks bonded together with a carbonaceous cement, or it may be formed using a rammed mixture of finely ground carbonaceous material and pitch. The anode, which usually comprises one or more carbonaceous blocks, is suspended above the cell floor. Resting on the cell floor is a layer or "pad" of molten aluminum which the bath sees as the true cathode. The anode, which projects down into the bath, is normally spaced from the pad at a distance of about 1.5 to 3.0 inches (3.81 to 7.62 centimeters). The alumina-cryolite bath is maintained on top of the pad at a depth of about 6.0 to 12.0 inches (15.24 to 30.48 centimeters).

As the bath is traversed by electric current, alumina is reduced to aluminum at the cathode and carbon is oxidized to its dioxide at the anode. The aluminum thus produced is deposited on the pad and tapped off periodically after it has accumulated. For the electrolytic process to proceed efficiently, the alumina reduction should occur onto a cathode surface of aluminum and not the bare carbonaceous surface of the cell floor. Therefore, it is considered important for the pad to cover the cell floor completely.

As molten aluminum does not readily wet or spread thinly on carbonaceous materials, the pad can best be visualized as a massive globule on the cell floor. In larger cells, the dense currents of electrolysis give rise to powerful magnetic fields, sometimes causing the pad to be violently stirred and to be piled up in selected areas within the cell. Therefore, the pad must be thick enough so that its movements do not expose the bare surface of the cell floor. Additionally, the anode must be sufficiently spaced from the pad to avoid short circuiting and to minmize reoxidation of aluminum.

Still, the movements of the pad have adverse effects which cannot always be readily controlled. For a given cell operating with a particular current of electrolysis, there is an ideal working distance between the cathode and the anode for which the process will be most energy efficient. However, the required spacing of the anode due to turbulence of the pad prevents this ideal working distance from being constantly maintained. Further, since the pad is in a state of movement, a variable, nonuniform working distance is presented. This variable interelectrode distance can cause uneven wear or consumption of the anode. Pad turbulence can also cause an increase in back reaction or reoxidation at the anode of cathodic products, which lowers cell efficiency. In addition, pad turbulence leads to accelerated bottom liner distortion and degradation through thermal effects and through penetration by the cryolite and its constitutents.

It has been suggested in the literature and prior patents that certain special materials, such a refractory hard metals (RHM), most notably titanium dioboride ($TiB_2$) or its homologs can be used advantageously in forming the cell floor. Further, it has been found that RHM tile materials may be embedded into the cell floor, rising vertically through the molten aluminum layer and into the cryolite-alumina bath, with the uppermost ends of these tiles forming the true cathode. When such a cathode design is employed, precise spacing between the true or active surfaces of the cathode and the anode may be maintained, since such a system is not affected by the ever-moving molten aluminum pad acting as the true cathode surface.

Ideally, in contrast to conventional carbon products, these RHM materials are chemically compatibile with the electrolytic bath at the high temperatures of cell operation and are also comparable chemically with molten aluminum.

Furthermore, the special cell floor materials are wetted by molten aluminum. Accordingly, the usual thick metal pad should no longer be required, and molten aluminum may be maintained on the cell floor as a relatively thin layer and commensurate with amounts accumulating between the normal tapping schedule.

With all of their benefits to the reduction process, there is a problem associated with the use of RHM tiles as the reduction cell floor and/or as vertically projecting members into the alumina-cryolite bath. When attached to carbonaceous substrates, such as the carbonaceous cathode of a reduction cell, erosion occurs at the RHM tile-carbonaceous substrate interface in the presence of molten aluminum and electrolyte. It is believed that this erosion is primarily chemical in nature, with the molten aluminum wetting the tile surface and reacting with the carbon to form $Al_4C_3$ which then dissolves in the electrolyte. This sets up a mechanism for removal of carbon from the tile interface and below, causing detachment of the cathodic tiles from the carbonaceous substrate.

It is thus a primary object of the present invention to avert the cause of this reaction while maintaining the advantages of the wetted RHM cathode and electrical connection to a practical substrate for the active cathode.

THE PRESENT INVENTION

By means of the present invention, the above-stated objective is obtained. According to the present invention, a solid alumina-cryolite layer is provided between the carbonaceous substrate floor and the non-cathodic molten aluminum pad. This stable cryolite-alumina layer prevents molten aluminum from reaching the RHM tile-carbonaceous substrate interface, thus eliminating the cause of erosion of carbon at this interface, as described above. The mixture is preferably formulated with a proportion of alumina greater than 20 weight percent, so that the melting point of the mixture is higher than normally experienced upper temperatures of aluminum production, such as about 1040° C., which may be reached in the cell.

BRIEF DESCRIPTION OF THE DRAWING

The alumina reduction cell of the present invention will be more fully described with reference to the drawing in which:

The FIGURE is a side elevational view of an alumina reduction cell, with the end wall removed, according to the practice of the present invention.

DETAILED DESCRIPTION OF THE PREFERRED EMBODIMENT

The FIGURE illustrates an alumina reduction cell 1 employing the present invention. Anode blocks 10, formed from a carbonaceous material, are suspended within a bath 16 of alumina dissolved in molten cryolite and are attached to a source of electrical current by means not shown. Carbonaceous cathode blocks 12 may be joined together by a rammed mixture of pitch and ground carbonaceous material or by means of a carbonaceous cement, by means well known to those skilled in the art. These cathode blocks 12 are connected by means of conductor bus bars 20 to the electrical current source to complete the electrical circuit. Outer walls 14 form the side and end supporting structures for the cell 1. The walls 14 may be formed, for example, from graphite blocks held together with a graphitic cement.

The carbonaceous blocks 12 include a plurality of tiles 22, which tiles project upwardly into the molten cryolite-alumina bath 16 and form the actual cathode surface for the cell 1. The tiles 22 are refractory hard metal (RHM) tiles, which may be formed of such materials as $TiB_2$, $TiB_2$-AlN mixtures, and other similar materials, typically by hot pressing or sintering RHM powders to form the shapes. These refractory hard metal materials are wetted by molten aluminum, where they pass through the molten aluminum 18 layer, preventing globules of molten aluminum from forming at the interfaces with the tiles 22.

To minimize cracking during use of these tiles, due to the brittleness of the RHM materials, the RHM tiles 22 may be reinforced with carbon, graphite or silicon carbide fibers or particles, which are added to the powders forming these tiles 22 prior to hot pressing or sintering. When fibers are employed, the fibers may be random or uniform in length and are oriented in the plane perpendicular to the direction of hot pressing. The fibers or particles act to resist tensile stresses that could result in cracking during use.

Beneath the molten aluminum layer 18 is an additional layer 19 of solid cryolite-alumina. This layer 19, having a thickness preferably ranging from about 1.0 to 4.0 inches (2.54 to 10.16 centimeters), rests upon the cell floor formed by carbonaceous blocks 12. As this mixture is solid, resistant to aluminum and not subject to continual reequilibrium with the bath, the layer 19 is dimensionally and chemically stable, providing continuing protection for the RHM tile-carbonaceous substrate interface by preventing molten aluminum from layer 18 from contacting this interface.

The ratio of molten cryolite to alumina in layer 19 may range from about 20% cryolite and 80% alumina to about 80% cryolite and 20% alumina, by weight, with a preferred composition of about 30% cryolite and 70% alumina, by weight.

By employing the vertically upstanding RHM shapes (T-shapes or tiles) 22, an active cathode surface may be provided at a distance from the anode of about 0.59 to 1.38 inches (1.5 to 3.5 centimeters), reducing electrical resistance and increasing the efficiency of the cell. This reduces the energy required to convert the alumina to aluminum, in turn reducing the costs of production of the aluminum so produced.

From the foregoing, it is clear that the present invention provides a simple, yet effective, means for preventing erosion at an RHM-carbonaceous interface within an alumina reduction cell.

While presently preferred embodiments of the invention have been illustrated and described, it is clear that the invention may be otherwise variously embodied and practiced within the scope of the following claims.

I claim:

1. In an alumina reduction cell having an anode, a carbonaceous cathode forming the floor of said cell and a plurality of refractory hard metal (RHM) shapes extending vertically upwardly from said cathode the improvement comprising a solid layer of a cryolite-alumina composite resting on said cell floor, said solid cryolite-alumina composite layer comprising between about 20–80% by weight cryolite and between about 20–80% by weight alumina, said RHM shapes passing through said solid cryolite-alumina composite layer.

2. The cell of claim 1 wherein said solid cryolite-alumina composite layer comprises about 30% by weight cryolite and about 70% by weight alumina.

3. The cell of claim 1 wherein said solid cryolite-alumina composite layer has a thickness ranging between about 1.0 to 4.0 inches (2.54 to 10.16 centimeters).

4. The cell of claim 1 wherein said RHM shapes are formed from $TiB_2$.

5. The cell of claim 1 wherein said RHM shapes are formed from a $TiB_2$-AlN mixture.

* * * * *